US008953979B2

(12) United States Patent
Mori et al.

(10) Patent No.: US 8,953,979 B2
(45) Date of Patent: Feb. 10, 2015

(54) IMAGE FORMING APPARATUS HAVING SUPPORTING MEMBER CONFIGURED TO HOLD DEVELOPING SECTIONS

(75) Inventors: Hirotaka Mori, Nagoya (JP); Hiroshi Nakano, Nagoya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 456 days.

(21) Appl. No.: 13/349,657

(22) Filed: Jan. 13, 2012

(65) Prior Publication Data

US 2012/0183321 A1 Jul. 19, 2012

(30) Foreign Application Priority Data

Jan. 14, 2011 (JP) ..... 2011-005918

(51) Int. Cl.

| | |
|---|---|
| ***G03G 15/00*** | (2006.01) |
| ***G03G 15/04*** | (2006.01) |
| ***G03G 21/16*** | (2006.01) |
| ***G03G 15/01*** | (2006.01) |

(52) U.S. Cl.

CPC ..... *G03G 21/1633* (2013.01); *G03G 15/0178* (2013.01); *G03G 2215/0141* (2013.01); *G03G 2221/1684* (2013.01); *G03G 2221/169* (2013.01)

USPC ..... 399/110; 399/111; 399/117; 399/118; 399/119

(58) Field of Classification Search

USPC ..... 399/110, 111, 117–119

See application file for complete search history.

(56) References Cited

U.S. PATENT DOCUMENTS

| | | | | |
|---|---|---|---|---|
| 5,089,846 | A | 2/1992 | Tabuchi | |
| 5,096,316 | A | 3/1992 | Otsuka et al. | |
| 5,339,132 | A * | 8/1994 | Tomita et al. | 399/4 |
| 5,808,649 | A * | 9/1998 | Shimanari et al. | 347/115 |

(Continued)

FOREIGN PATENT DOCUMENTS

| | | |
|---|---|---|
| JP | 02-137967 A | 5/1990 |
| JP | 04-096082 A | 3/1992 |

(Continued)

OTHER PUBLICATIONS

Machine translation of JP 2002268320 A.*

(Continued)

*Primary Examiner* — David Bolduc

(74) *Attorney, Agent, or Firm* — Banner & Witcoff, Ltd.

(57) ABSTRACT

An apparatus main body has an opening at a front side. A developing-section supporting member configured to hold developing sections and to be pulled in a pulling direction through the opening from an internal position inside the apparatus main body to an external position outside the apparatus main body at which the developing sections is configured to be mounted and dismounted. Exposing members emit light in an optical axis direction for forming a latent image on respective photosensitive members. The exposing members are provided at the developing-section supporting member. A displacement mechanism is configured to support the developing-section supporting member and to displace the developing-section supporting member between: an adjacent position at which the developing-section supporting member is adjacent to the photosensitive members; and a separated position at which the developing-section supporting member is separated from the photosensitive members.

18 Claims, 11 Drawing Sheets

(56) References Cited

U.S. PATENT DOCUMENTS

| | | | | |
|---|---|---|---|---|
| 6,801,232 | B2 * | 10/2004 | Nagamine et al. | 347/149 |
| 7,444,100 | B2 * | 10/2008 | Sato | 399/110 |
| 7,447,467 | B2 | 11/2008 | Kamimura et al. | |
| 7,792,464 | B2 * | 9/2010 | Okabe et al. | 399/228 |
| 7,840,159 | B2 * | 11/2010 | Nakashima | 399/117 |
| 8,150,294 | B2 * | 4/2012 | Okabe et al. | 399/118 |
| 8,165,501 | B2 * | 4/2012 | Tamura et al. | 399/123 |
| 8,207,995 | B2 * | 6/2012 | Tamaru et al. | 347/242 |
| 8,260,171 | B2 * | 9/2012 | Matsuda | 399/110 |
| 8,311,437 | B2 | 11/2012 | Sato | |
| 2001/0021321 | A1 * | 9/2001 | Kikuchi et al. | 399/118 |
| 2003/0053819 | A1 | 3/2003 | Nomura et al. | |
| 2004/0165910 | A1 * | 8/2004 | Sato et al. | 399/116 |
| 2006/0067734 | A1 * | 3/2006 | Igarashi et al. | 399/119 |
| 2006/0140673 | A1 | 6/2006 | Kamimura et al. | |
| 2006/0140674 | A1 * | 6/2006 | Sato | 399/119 |
| 2008/0219696 | A1 * | 9/2008 | Itabashi | 399/114 |
| 2008/0304860 | A1 * | 12/2008 | Hisada | 399/110 |
| 2009/0028602 | A1 * | 1/2009 | Kamimura et al. | 399/113 |
| 2009/0047041 | A1 * | 2/2009 | Kubo et al. | 399/222 |
| 2009/0052938 | A1 * | 2/2009 | Sameshima et al. | 399/110 |
| 2009/0052960 | A1 * | 2/2009 | Tanaka et al. | 399/358 |
| 2009/0058978 | A1 * | 3/2009 | Itabashi | 347/152 |
| 2009/0087209 | A1 | 4/2009 | Yamaguchi | |
| 2009/0142092 | A1 | 6/2009 | Sato | |
| 2009/0190953 | A1 | 7/2009 | Okabe | |
| 2009/0220250 | A1 * | 9/2009 | Funahashi | 399/12 |
| 2009/0317130 | A1 | 12/2009 | Ishikawa et al. | |
| 2009/0317133 | A1 | 12/2009 | Nishimura et al. | |
| 2009/0324283 | A1 * | 12/2009 | Mushika et al. | 399/119 |
| 2010/0080616 | A1 * | 4/2010 | Kamimura | 399/111 |
| 2010/0183352 | A1 * | 7/2010 | Hisada | 399/405 |
| 2010/0209140 | A1 * | 8/2010 | Kamimura et al. | 399/111 |
| 2011/0299883 | A1 * | 12/2011 | Suzuki | 399/110 |
| 2012/0027472 | A1 | 2/2012 | Kamimura et al. | |
| 2012/0163857 | A1 * | 6/2012 | Kamimura | 399/110 |
| 2012/0308273 | A1 | 12/2012 | Kamimura et al. | |
| 2012/0328333 | A1 * | 12/2012 | Sameshima et al. | 399/222 |

FOREIGN PATENT DOCUMENTS

| | | | |
|---|---|---|---|
| JP | 09-174919 | A | 7/1997 |
| JP | 2002-268320 | A | 9/2002 |
| JP | 2003-076106 | | 3/2003 |
| JP | 2004-163826 | A | 6/2004 |
| JP | 2005-342979 | A | 12/2005 |
| JP | 2006-184552 | A | 7/2006 |
| JP | 2007-298655 | A | 11/2007 |
| JP | 2009-080394 | | 4/2009 |
| JP | 2009-139495 | | 6/2009 |
| JP | 2009-157135 | A | 7/2009 |
| JP | 2009-175416 | | 8/2009 |
| JP | 2009265128 | A * | 11/2009 |
| JP | 2010-008511 | | 1/2010 |
| JP | 2010-008512 | | 1/2010 |

OTHER PUBLICATIONS

Office Action issued in corresponding Japanese Patent Application No. 2011-005918 mailed Jan. 22, 2013.

* cited by examiner

FIG. 6A
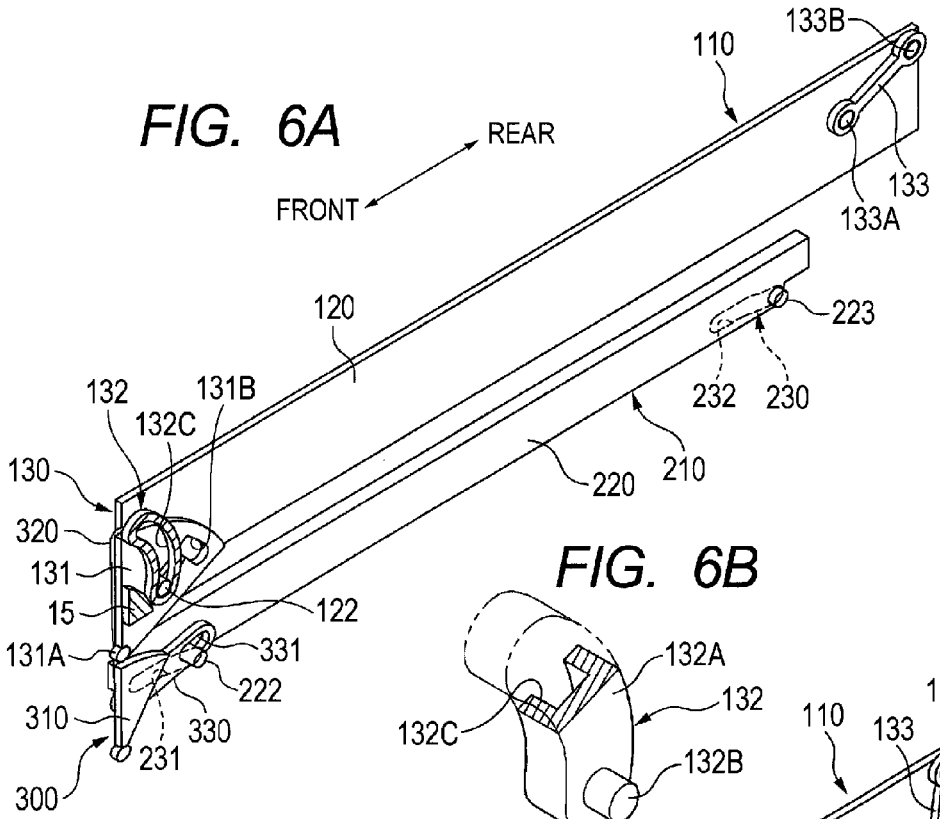
FIG. 6B
FIG. 6C
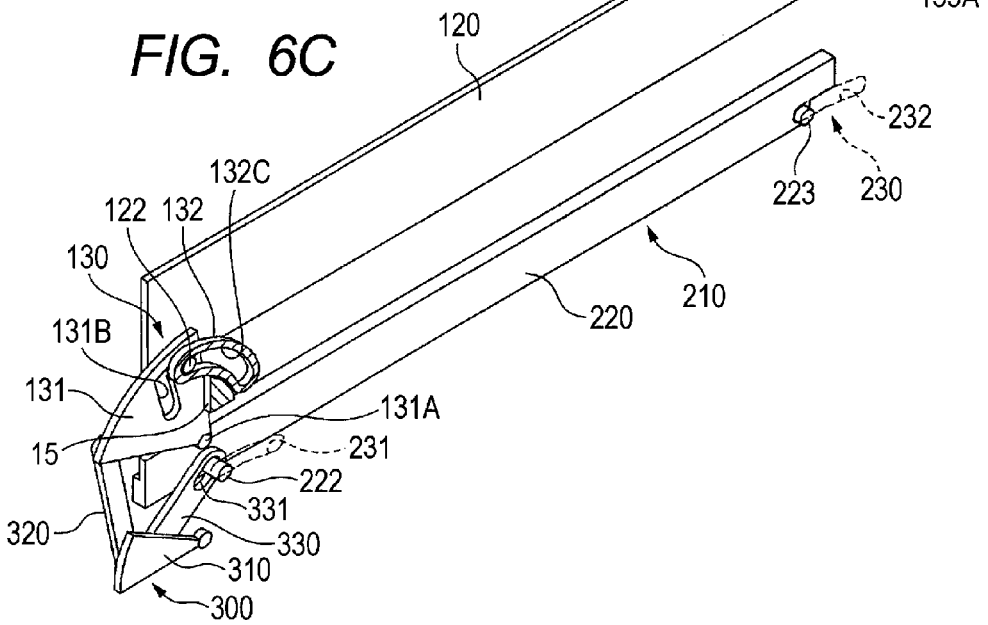

IMAGE FORMING APPARATUS HAVING SUPPORTING MEMBER CONFIGURED TO HOLD DEVELOPING SECTIONS

CROSS REFERENCE TO RELATED APPLICATIONS

This application claims priority from Japanese Patent Application No. 2011-005918 filed Jan. 14, 2011. The entire content of the priority application is incorporated herein by reference.

TECHNICAL FIELD

The invention relates to an image forming apparatus.

BACKGROUND

Conventionally, an image forming apparatus including a top cover configured to open/close is known. By opening/closing the top cover, an exposing member such as LED is configured to be moved between an exposing position adjacent to a photosensitive drum and a separated position separated from the photosensitive drum.

SUMMARY

In the above-mentioned image forming apparatus, a developing cartridge is replaced through an opening of the top cover. However, a space for opening the top cover is required above the image forming apparatus, and a replacement operation of the developing cartridge can be difficult. Such a problem may occur to an image forming apparatus in which not only LEDs but also a large number of EL elements is arranged.

In view of the foregoing, it is an object of the invention to provide an image forming apparatus that facilitates a replacement operation of a developing cartridge (developing section) of the image forming apparatus.

In order to attain the above and other objects, the invention provides an image forming apparatus. The image forming apparatus includes an apparatus main body, a plurality of photosensitive members, a plurality of developing sections, a developing-section supporting member, a plurality of exposing members, and a displacement mechanism. The apparatus main body has an opening at a front side. The plurality of developing sections is each provided for a corresponding one of the plurality of photosensitive members. The developing-section supporting member is configured to hold the plurality of developing sections and configured to be pulled in a pulling direction through the opening from an internal position inside the apparatus main body to an external position outside the apparatus main body at which the plurality of developing sections is configured to be mounted and dismounted. The plurality of exposing members is each provided for a corresponding one of the plurality of photosensitive members and is configured to emit light in an optical axis direction for forming a latent image on the corresponding one of the plurality of photosensitive members. The plurality of exposing members is provided at the developing-section supporting member. The displacement mechanism is configured to support the developing-section supporting member and to displace the developing-section supporting member between: an adjacent position at which the developing-section supporting member is adjacent to the plurality of photosensitive members; and a separated position at which the developing-section supporting member is separated from the plurality of photosensitive members.

BRIEF DESCRIPTION OF THE DRAWINGS

Embodiments in accordance with the invention will be described in detail with reference to the following figures wherein:

FIG. 6A is a perspective view showing the cam mechanisms in a state where the front cover is at the closed position;

FIG. 6B is a perspective view showing an arc-like member as viewed from the outside in the left-right direction;

FIG. 6C is a perspective view showing the cam mechanisms in a state where the front cover is at the open position;

DETAILED DESCRIPTION

Figure 1:
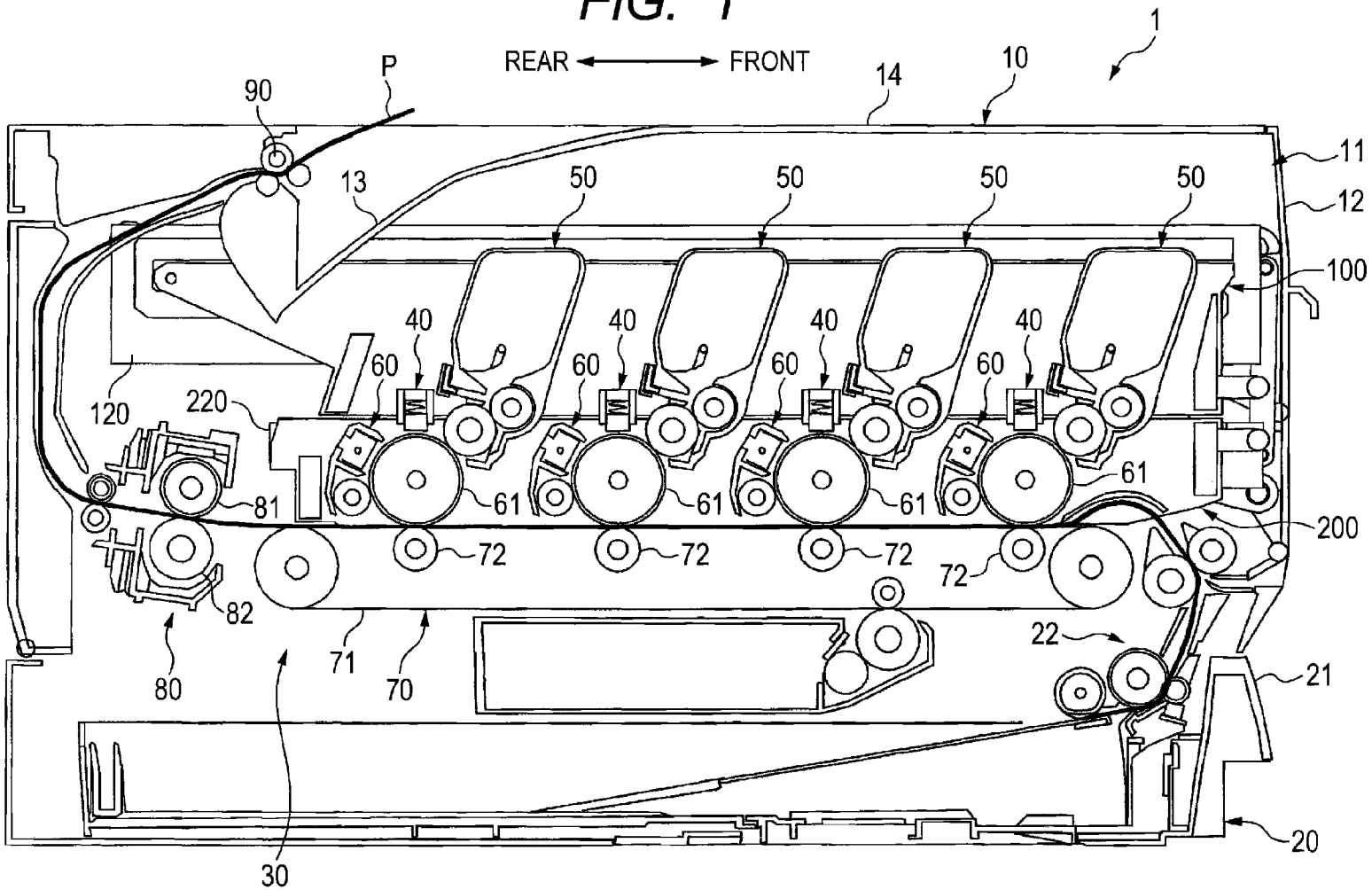
FIG. 1 is a vertical cross-sectional view showing a color printer embodying an image forming apparatus according to an embodiment of the invention.

A color printer embodying an image forming apparatus according to an embodiment of the invention will be described while referring to FIGS. 1 through 9.

In the following description, the expressions "front", "rear", "upper", "lower", "right", and "left" are used to define the various parts when the color printer is disposed in an orientation in which it is intended to be used by a user. That is, in FIG. 1, the right side on the drawing sheet is defined as the "front" side, the left side on the drawing sheet is defined as the "rear" side, the far side in a direction perpendicular to the drawing sheet is defined as the "right" side, and the near side in the direction perpendicular to the drawing sheet is defined as the "left" side. Further, the upper and lower direction on the drawing sheet is defined as the "upper-lower direction".

As shown in FIG. 1, a color printer 1 includes, within an apparatus main body 10, a paper feeding section 20 that feeds paper P (recording sheet) and an image forming section 30 that forms an image by superposing images corresponding to respective colors of K (black), C (cyan), M (magenta), Y (yellow) on fed paper P.

An opening 11 (see FIG. 2) is formed at a front wall of the apparatus main body 10. A front cover 12 is also provided pivotally at the front wall so as to open and close the opening 11. Specifically, the front cover 12 is pivotally movable (displaceable) between a closed position (the position shown in FIG. 1) at which the opening 11 is closed and an open position (the position shown in FIG. 2) at which the opening 11 is opened.

The paper feeding section 20 includes a paper feeding tray 21 that accommodates paper P and a paper conveying device 22 that conveys paper P from the paper feeding tray 21 to the image forming section 30.

The image forming section 30 includes four LED arrays 40 (an example of a plurality of exposing members), four developing cartridges 50 (an example of a plurality of developing sections), four drum units 60, a transfer unit 70, and a fixing unit 80.

Each LED array 40 includes a semiconductor chip and a plurality of LEDs so as to expose a corresponding one of photosensitive drums 61 described later (an example of photosensitive members) to light along a main scanning direction (the axial direction of the photosensitive drum 61). The four LED arrays 40 for respective colors are arranged above and adjacent to the respective photosensitive drums 61 so as to correspond to the four photosensitive drums 61 for the respective colors, and are supported by a developing-section drawer 100 described later (an example of a developing-section supporting member).

The developing cartridges 50 are arranged in the front-rear direction. Each of the developing cartridges 50 includes a developing roller, a layer-thickness regulating blade, a toner accommodating chamber (shown in the drawing, but reference signs are omitted), and the like, which are well-known in the art. Four developing cartridges 50 accommodate therein toner in the respective colors and are arranged adjacent to and diagonally forward above the respective photosensitive drums 61 so as to correspond to the four photosensitive drums 61. The developing cartridges 50 are detachably mounted on the developing-section drawer 100 described later. The developing cartridges 50 are held by the developing-section drawer 100 between left and right side walls 101 of the developing-section drawer 100.

Each drum unit 60 includes the photosensitive drum 61, a well-known charger (shown in the drawing, but reference signs are omitted), and the like. The four drum units 60 are fixed to a photosensitive-member drawer 200 described later (an example of a photosensitive-member supporting member). Note that the drum units 60 may be configured to be detachably mounted on the photosensitive-member drawer 200.

The transfer unit 70 is provided between the paper feeding section 20 and the photosensitive drums 61. The transfer unit 70 includes an endless conveying belt 71 looped around a plurality of rollers, and four transfer rollers 72. The conveying belt 71 is disposed below the photosensitive drums 61 so as to confront the plurality of photosensitive drums 61. The transfer rollers 72 are arranged inside the conveying belt 71 so as to sandwich the conveying belt 71 with the respective photosensitive drums 61.

The fixing unit 80 is disposed at the rear side of the developing cartridges 50 and the transfer unit 70. The fixing unit 80 includes a heat roller 81 and a pressure roller 82 arranged to confront the heat roller 81 for pressing the heat roller 81.

In the image forming section 30 having the above-described configuration, first, a surface of each photosensitive drum 61 is charged uniformly by the charger, and is then exposed to light by the LED array 40. With this operation, an electric potential of exposed portions decreases, and an electrostatic latent image is formed on each photosensitive drum 61 based on image data. Subsequently, toner is supplied to the electrostatic latent image from the developing roller so that a toner image is borne on the photosensitive drum 61.

Next, the paper P conveyed onto the conveying belt 71 passes between the photosensitive drums 61 and the respective transfer rollers 72, so that the toner image formed on each photosensitive drum 61 is transferred onto the paper P. Then, the paper P passes between the heat roller 81 and the pressure roller 82, and the toner image transferred onto the paper P is thermally fixed onto the paper P.

Then, the paper P subjected to thermal fixing by the fixing unit 80 is discharged outside of the apparatus main body 10 by discharge rollers 90 arranged at the downstream side of the fixing unit 80, and is placed on a discharge tray section 13 formed at a rear part of an upper wall 14 of the apparatus main body 10. Here, the discharge tray section 13 is formed to be concave downward at a center part of the upper wall 14 of the apparatus main body 10 in the left-right direction, so that spaces are formed at the left and right sides of the discharge tray section 13.

<Structure of Developing-Section Drawer 100 and Photosensitive-member Drawer 200 and Surrounding Parts>

Next, the structure of the developing-section drawer 100 and the photosensitive-member drawer 200 and their surrounding parts will be described in detail.

Figure 2:
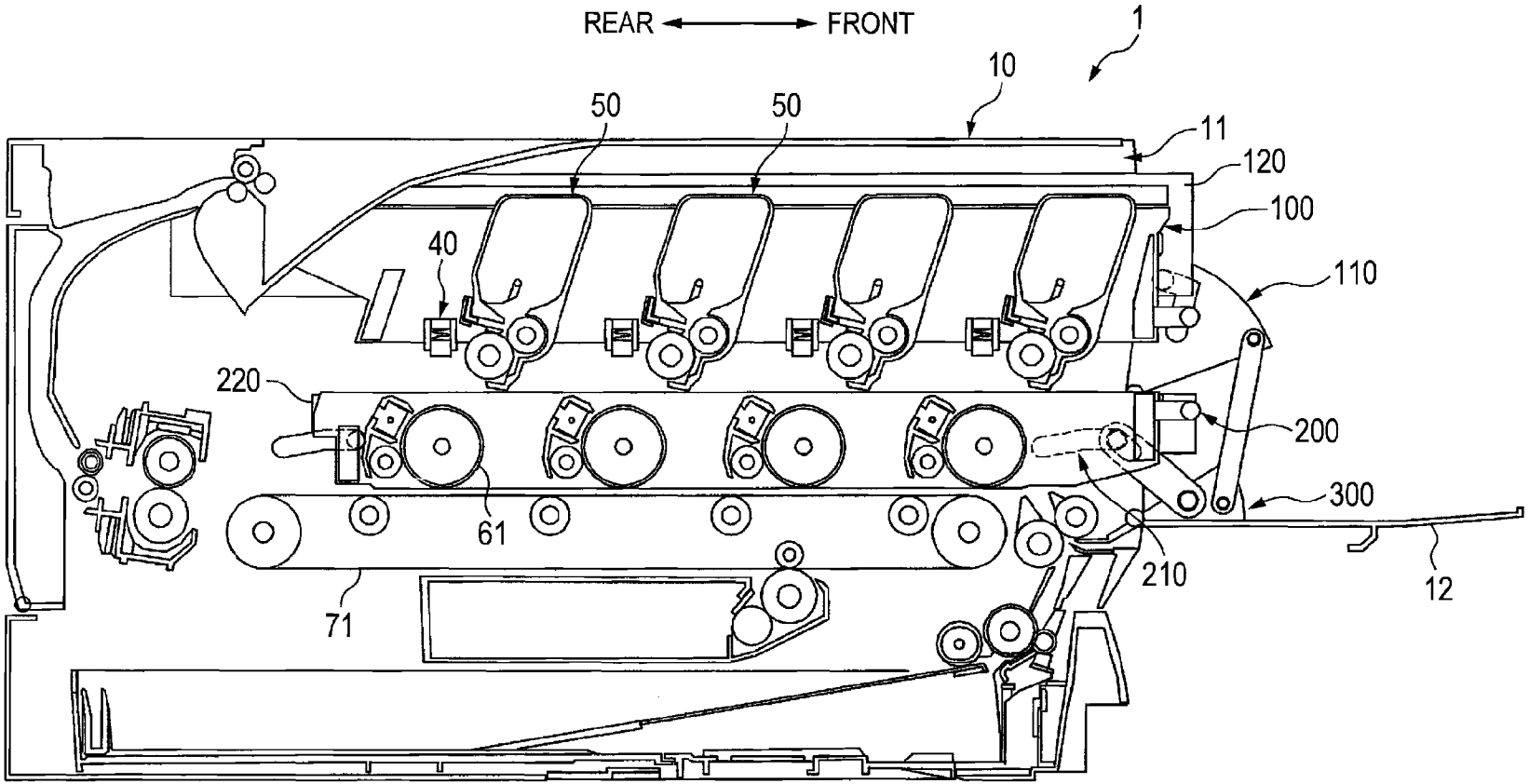
FIG. 2 is a vertical cross-sectional view showing a state in which drawers are located at respective separated positions.
Figure 3:
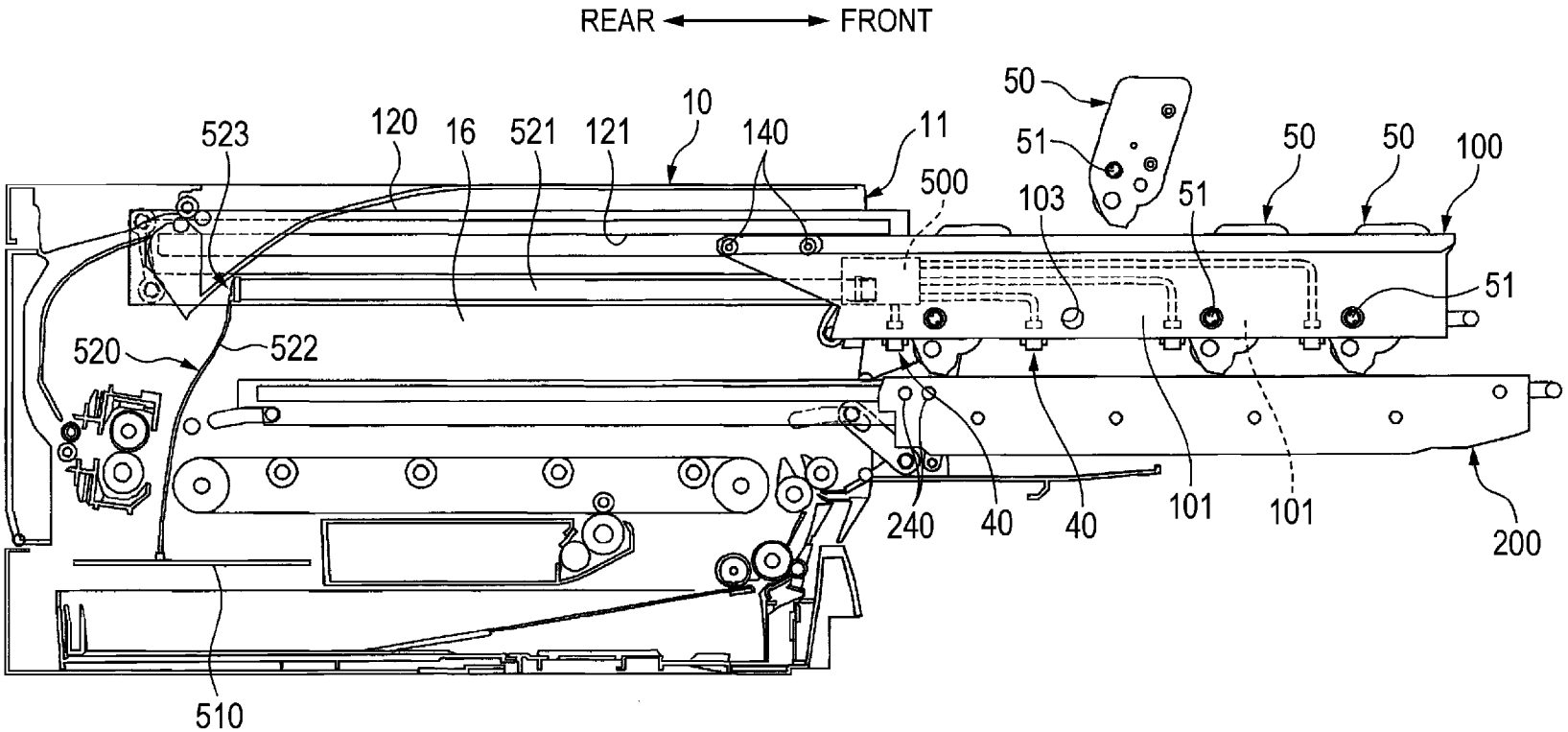
FIG. 3 is a vertical cross-sectional view showing a state in which the drawers are pulled out.
Figure 4:
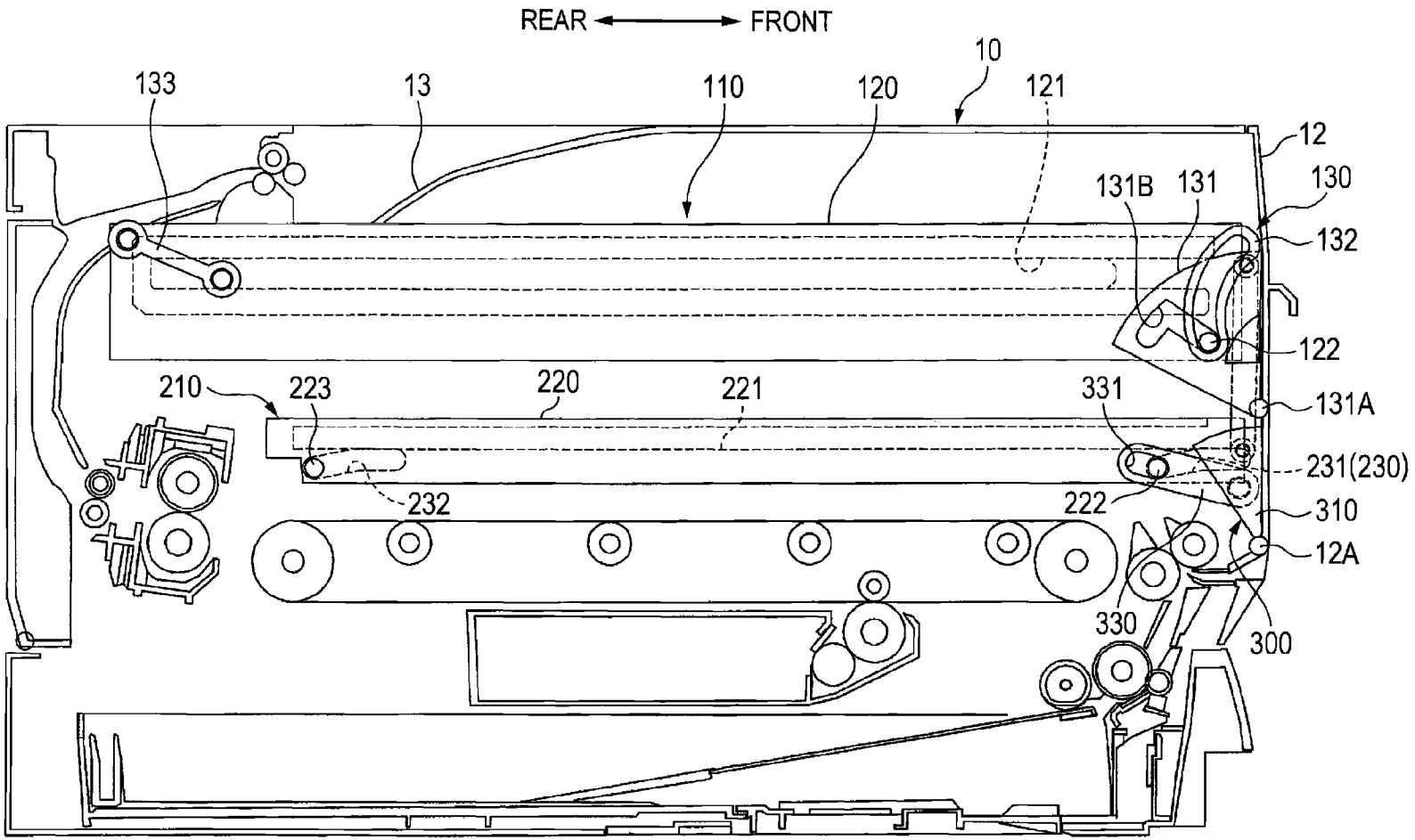
FIG. 4 is a vertical cross-sectional view showing cam mechanisms in a state where a front cover is at a closed position.

As shown in FIG. 2, each of the developing-section drawer 100 and the photosensitive-member drawer 200 moves upward when the front cover 12 is opened and, as shown in FIG. 3, is configured to be pulled out forward through the opening 11 from the respective positions moved upward. That is, each of the developing-section drawer 100 and the photosensitive-member drawer 200 is movable in the vertical direction (the optical axis direction of the LED array 40), and is also movable in the front-rear direction (the direction in which the plurality of photosensitive drums 61 is arranged).

Specifically, as shown in FIGS. 4 through 6C, a developing-section displacement mechanism 110, a photosensitive-member displacement mechanism 210, an interlocking mechanism 300 are provided within the apparatus main body 10.

The developing-section displacement mechanism 110 supports the developing-section drawer 100 to be displaceable (movable) between: a first adjacent position at which the developing-section drawer 100 is adjacent to the photosensitive drums 61 in the vertical direction (the optical axis direction of the LED arrays 40) (the position shown in FIG. 1); and a first separated position at which the developing-section drawer 100 is separated (spaced away) from the photosensitive drums 61 (the position shown in FIG. 2). Specifically, the developing-section displacement mechanism 110 includes developing-section guides 120 and a first cam mechanism 130. The developing-section guides 120 support the developing-section drawer 100 so as to be slidable in the front-rear direction (the pulling direction). The first cam mechanism 130 moves the developing-section guide 120 between the first adjacent position and the first separated position. As described below, the developing-section displacement mechanism 110 displaces the developing-section drawer 100 by displacing the developing-section guides 120.

Figure 7:
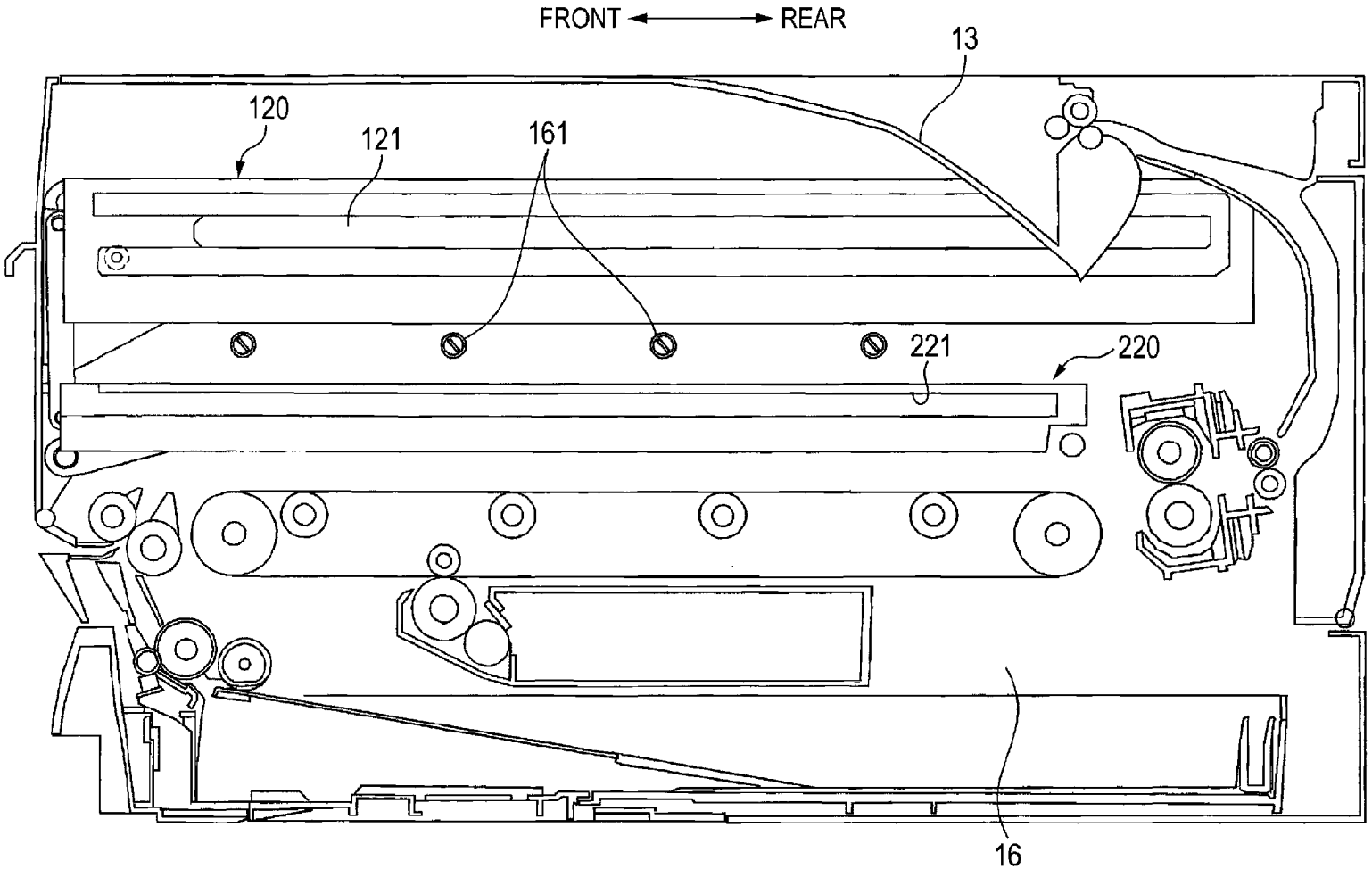
FIG. 7 is a vertical cross-sectional view showing a left-side side wall of an apparatus main body.

The developing-section guides 120 are a pair of plate-shaped members extending in the front-rear direction along left and right side walls of the apparatus main body 10. That is, each plate-shaped member is provided at the left and right sides of the apparatus main body 10. As shown in FIG. 7, an elongated guide groove 121 extending in the front-rear direction is formed at a predetermined position of the developing-section guide 120. The guide groove 121 is so configured that wheels 140 (see FIG. 3) provided at the left and right sides of the developing-section drawer 100 are fitted in the guide groove 121 and are configured to roll along the guide groove 121.

With this configuration, when the wheels 140 of the developing-section drawer 100 are in contact with the rear ends of the guide grooves 121, the developing-section drawer 100 is located at a mount position inside the apparatus main body 10 (see FIG. 2). On the other hand, when the developing-section drawer 100 is pulled out from the mount position so that the wheels 140 of the developing-section drawer 100 are in contact with the front end of the guide groove 121, the developing-section drawer 100 is located at a replacement position outside the apparatus main body 10 (see FIG. 3) at which each developing cartridge 50 is configured to be mounted and dismounted. That is, the developing-section drawer 100 has a structure that is not configured to be detached from the apparatus main body 10 unless a tool such as a driver is used.

Figure 5:
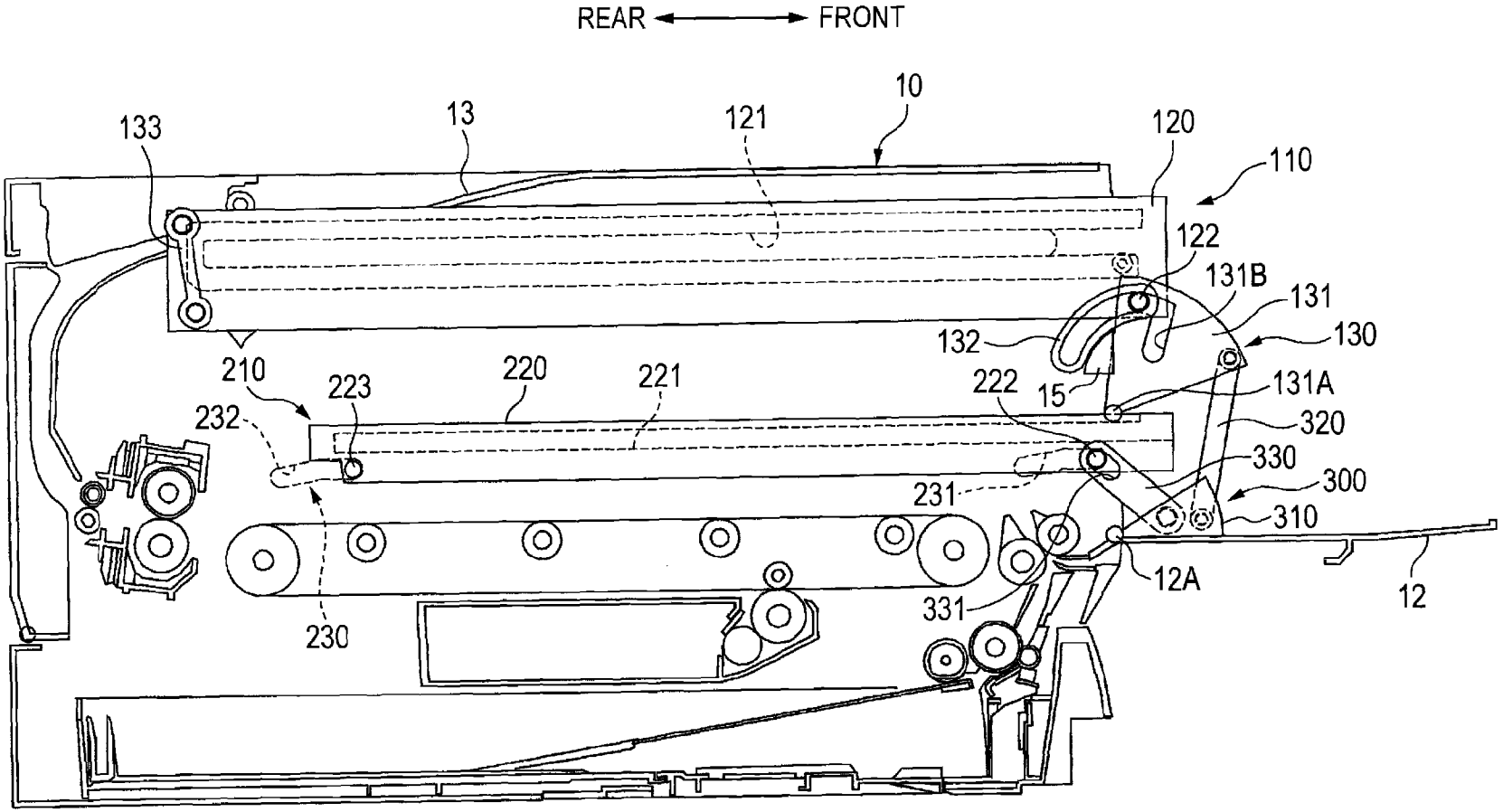
FIG. 5 is a vertical cross-sectional view showing the cam mechanisms in a state where the front cover is at an open position.

As shown in FIG. 5, the pair of developing-section guides 120 is arranged in the spaces formed at the left and right sides of the discharge tray section 13 so as to sandwich the discharge tray section 13 in the left-right direction when the developing-section guides 120 are located at the first separated position. That is, the developing-section guides 120 and the discharge tray section 13 are arranged at positions that overlap each other as viewed from the left or right side of the apparatus main body 10 (from the axial direction of the photosensitive drums 61). With this configuration, the spaces formed at the left and right sides of the discharge tray section 13 are utilized efficiently as spaces for arranging the developing-section guides 120, thereby enabling the apparatus main body 10 to be downsized in the vertical direction.

The first cam mechanism 130 includes a swing cam 131, an arc-like member 132, and a rear support member 133.

The swing cam 131 is supported by the apparatus main body 10 so as to be swingable about a swing shaft 131A. The swing cam 131 is formed substantially in a fan shape of which the center is the swing shaft 131A. An L-shaped groove 131B is formed at a predetermined position of the swing cam 131. The groove 131B engages a cylindrical-shaped protrusion 122 provided at a front-lower part of the developing-section guide 120. With this configuration, when the swing cam 131 is pivotally moved from the orientation shown in FIG. 4 to the orientation shown in FIG. 5, the inner surface of the groove 131B serves as a cam face to push the protrusion 122 in a diagonally forward upper direction so that the front part of the developing-section guide 120 is lifted in the diagonally forward upper direction.

The swing shaft 131A of the swing cam 131 is located at a position closer to the developing-section guide 120 (the developing-section drawer 100) than a swing shaft 12A of the front cover 12. With this configuration, compared with a structure in which the swing axis of the swing cam is located at the same position as the swing axis of the front cover, the amount of movement of the swing cam 131 in the vertical direction can be secured while reducing the amount of movement of the swing cam 131 in the front-rear direction. Thus, the apparatus main body 10 can be downsized in the front-rear direction.

As shown in FIG. 6B, the arc-like member 132 includes an arc-like main body section 132A and a pivot shaft 132B protruding from the lower end of the main body section 132A toward the apparatus main body 10 side. As shown in FIGS. 6A through 6C, an arc-like groove 132C is formed in the main body section 132A. The groove 132C engages the protrusion 122 of the developing-section guide 120. The pivot shaft 132B is inserted in a hole formed in each side wall of the apparatus main body 10, so that the arc-like member 132 is configured to be pivotally moved about the pivot shaft 132B.

That is, the protrusion 122 of the developing-section guide 120 penetrates the groove 131B of the swing cam 131 and engages the groove 132C of the arc-like member 132. With this configuration, when the swing cam 131 is pivotally moved from the orientation shown in FIG. 6A to the orientation shown in FIG. 6C, the protrusion 122 is appropriately guided by the groove 132C of the arc-like member 132 so that the protrusion 122 is reliably moved from one end to the other end of the groove 132C of the arc-like member 132, thereby pushing the developing-section guide 120 in a diagonally front upper direction.

A stopper 15 is provided at the apparatus main body 10 for restricting a swing motion of the arc-like member 132 in the forward direction. With this configuration, movement of the developing-section guide 120 in a diagonally forward upper direction is restricted by the stopper 15 via the arc-like member 132 (see FIG. 5).

The rear support member 133 has one end 133A that is pivotally coupled to the apparatus main body 10 and another end 133B that is pivotally coupled to a rear upper part of the developing-section guide 120. With this configuration, when the developing-section guide 120 is pushed in a diagonally forward upper direction by the swing cam 131, the rear support member 133 swings from the orientation shown in FIG. 6A to the orientation shown in FIG. 6C in a rising manner, and the rear part of the developing-section guide 120 is also moved in a diagonally forward upper direction by the rear support member 133. That is, the developing-section guide 120 is configured to move while keeping a horizontal orientation due to the swing cam 131 and the rear support member 133.

The photosensitive-member displacement mechanism 210 supports the photosensitive-member drawer 200 such that the photosensitive-member drawer 200 is configured to be displaced between: a second adjacent position at which the photosensitive drums 61 are adjacent to (in contact with) the conveying belt 71 with respect to the vertical direction (see FIG. 1); and a second separated position at which the photosensitive drums 61 are separated from the conveying belt 71 (see FIG. 2). Specifically, the photosensitive-member displacement mechanism 210 includes photosensitive-member guides 220 and a second cam mechanism 230. The photosensitive-member guides 220 support the photosensitive-member drawer 200 such that the photosensitive-member drawer 200 is configured to slide in the front-rear direction. The second cam mechanism 230 moves the photosensitive-member guides 220 between the second adjacent position and the second separated position.

The photosensitive-member guides 220 are a pair of plate-shaped members extending in the front-rear direction along the left and right side walls of the apparatus main body 10. That is, each plate-shaped member is provided at the left and right sides of the apparatus main body 10. As shown in FIG. 7, a guide groove 221 extending in the front-rear direction and opened toward the front is formed at a predetermined position of the photosensitive-member guide 220. The guide groove 221 has substantially a squared U-shape in a side view. The guide groove 221 is so configured that wheels 240 (see FIG. 3) provided at the left and right sides of the photosensitive-member drawer 200 are fitted in the guide groove 221 and are configured to roll along the guide groove 221.

With this configuration, when the wheels 240 of the photosensitive-member drawer 200 are in contact with the rear ends of the guide grooves 221 (bottom faces of the squared U-shape), the photosensitive-member drawer 200 is located at an internal position inside the apparatus main body 10 (see FIG. 2). Further, when the photosensitive-member drawer 200 is pulled out from the internal position (mount position), the photosensitive-member drawer 200 is located at an external position outside the apparatus main body 10 (see FIG. 3). By pulling the photosensitive-member drawer 200 further outward from the external position, the photosensitive-member drawer 200 is configured to be dismounted from the apparatus main body 10 for replacement.

As shown in FIGS. 4 through 6C, the second cam mechanism 230 includes a front cam groove 231 and a rear cam groove 232 formed in the apparatus main body 10, and a front protrusion 222 and a rear protrusion 223 provided at the photosensitive-member guide 220.

Each of the front cam groove 231 and the rear cam groove 232 has an arc-like shape that is inclined upward from the rear toward the front. The front protrusion 222 engages the front cam groove 231, whereas the rear protrusion 223 engages the rear cam groove 232. With this configuration, when the photosensitive-member guide 220 is pulled toward the front, the photosensitive-member guide 220 moves along the front cam groove 231 and the rear cam groove 232 to be pushed up in a diagonally forward upper direction.

The amount of vertical movement of the photosensitive-member guide 220 pushed up by the second cam mechanism 230 is smaller than the amount of vertical movement of the developing-section guide 120 pushed up by the first cam mechanism 130. Each of the first cam mechanisms 130 and 230 is so configured that a distance between the first adjacent position and the first separated position is larger than a distance between the second adjacent position and the second separated position.

Hence, as shown in FIG. 2, when the front cover 12 is opened, the photosensitive drums 61 is configured to be separated from the conveying belt 71, and the developing cartridges 50 (the developing rollers) is also configured to be separated from the respective photosensitive drums 61.

As shown in FIGS. 4 through 6C, the interlocking mechanism 300 activates each of the cam mechanisms 130 and 230 in conjunction with an open/close operation of the front cover 12, thereby displacing the developing-section drawer 100 and the photosensitive-member drawer 200 from the respective adjacent positions to the respective separated positions when the front cover 12 is displaced from the closed position to the open position. Specifically, the interlocking mechanism 300 includes a fan-shape member 310, a first link member 320, and a second link member 330. The fan-shape member 310 is fixed to the front cover 12. The first link member 320 links the first cam mechanism 130 with the front cover 12 via the fan-shape member 310. The second link member 330 links the second cam mechanism 230 with the front cover 12 with the fan-shape member 310.

The fan-shape member 310 has a fan shape of which the center is the swing shaft 12A of the front cover 12. A pair of the fan-shape members 310 is provided at the left and right sides of the lower end part of the front cover 12, respectively.

The first link member 320 has one end that is pivotally coupled to the swing cam 131 and another end that is pivotally coupled to the fan-shape member 310.

The second link member 330 has one end that is pivotally coupled to the front protrusion 222 of the photosensitive-member guide 220 and another end that is pivotally coupled to the fan-shape member 310 (specifically, at a position between the swing shaft 12A of the front cover 12 and the another end of the first link member 320). An elongated hole 331 engaging the front protrusion 222 is formed at the one end of the second link member 330. The front end of the elongated hole 331 contacts the front protrusion 222 in a state where the front cover 12 is closed (see FIG. 4). The rear end of the elongated hole 331 contacts the front protrusion 222 in a state where the front cover 12 is opened (see FIG. 5). The elongated hole 331 extends substantially rearward (along the movement direction of the second link member 330) from the front end.

With this configuration, when the front cover 12 is opened from a closed state, the photosensitive-member guide 220 does not move until the front protrusion 222 contacts the rear end of the elongated hole 331 of the second link member 330. That is, the developing-section guide 120 starts moving in a diagonally upper front direction immediately after the front cover 12 is opened and subsequently, with a predetermined time interval (time lag), the photosensitive-member guide 220 starts moving in a diagonally upper front direction. This can reliably prevent interference between the developing-section guide 120 and the photosensitive-member guide 220.

Figure 8A:
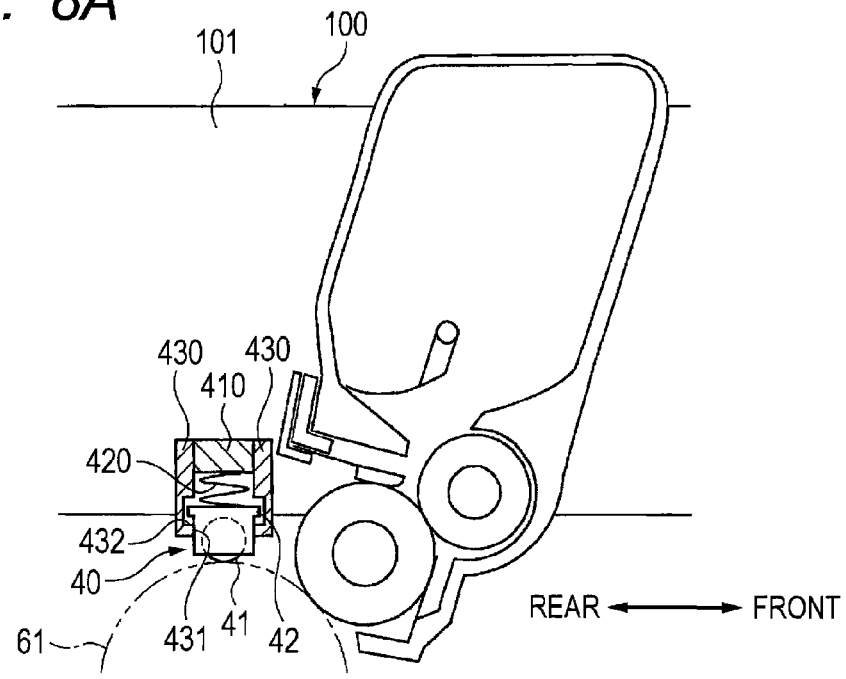
FIG. 8A is an enlarged cross-sectional view showing an LED array and its surrounding structure at a first adjacent position.

As shown in FIG. 8A, the LED array 40 is provided at the developing-section drawer 100 to be movable in the upper and lower direction (the vertical direction) via a support frame 410 and a coil spring 420 (an example of an urging member). A pair of guide members 430 (an example of a second restricting member) is also provided at the developing-section drawer 100.

The support frame 410 is a member extending in the left-right direction. The both ends of the support frame 410 are fixed to the left and right side walls 101 of the developing-section drawer 100.

The coil spring 420 is a spring that urges the LED array 40 toward the photosensitive drum 61. The coil spring 420 is provided at the developing-section drawer 100 via the support frame 410. Specifically, the coil spring 420 has one end that is fixed to the support frame 410 and another end that is fixed to the LED array 40.

Guide rollers 41 (an example of a first restricting member) are rotatably provided at the left and right sides of the LED array 40, such that the guide rollers 41 protrude downward from the lower end (lens surface) of the LED array 40 to contact the photosensitive drum 61. With this configuration, at the first adjacent position (the position shown in FIG. 8A), the coil spring 420 urges the LED array 40 toward the photosensitive drums 61 so that the guide rollers 41 contact the photosensitive drum 61. In this manner, the guide rollers 41 restrict movement of the LED array 40 toward the photosensitive drum 61 side.

Hence, in a state where the guide rollers 41 are in contact with the photosensitive drum 61, a distance between the LED array 40 (lens surface) and the photosensitive drum 61 is kept at a constant value, so that the LED array 40 is configured to be positioned relative to the photosensitive drum 61 with respect to the optical axis direction.

The guide members 430 are provided to sandwich the LED array 40 in the front-rear direction. Each inner surface of the guide members 430 serves as a guide surface 431 in contact with the LED array 40. A guide groove 432 that is elongated in the vertical direction (in cross-section) is formed in each guide surface 431. A restricting pin (restricting protrusion) 42 engaging the guide groove 432 is provided at each of the front and rear surfaces of the LED array 40.

Figure 8B:
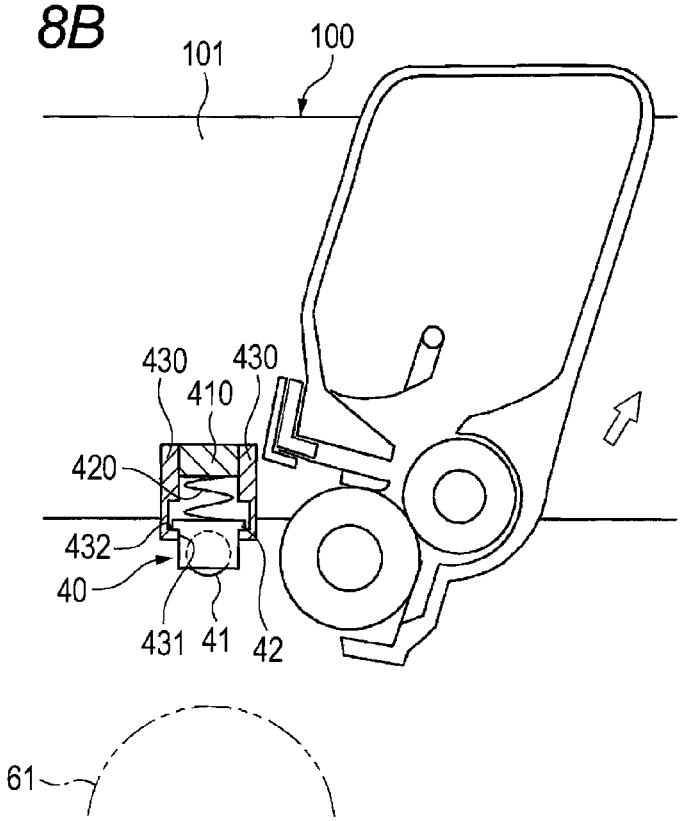
FIG. 8B is an enlarged cross-sectional view showing the LED array and its surrounding structure at a first separated position.

With this configuration, as shown in FIG. 8B, in a state where the developing-section drawer 100 is located at the first separated position, the coil spring 420 urges the LED array 40 downward until each restricting pin 42 contacts the lower end of each guide groove 432. This restricts downward movement of the LED array 40 (toward the photosensitive drum 61 side), so that the LED array 40 is configured to be reliably separated from the photosensitive drum 61.

Specifically, positions and sizes of each restricting pin 42 and each guide groove 432 are so set that the lower part of the LED array 40 (the lowest surface of the guide roller 41) is located at an upper position than the lowest part of the developing cartridge 50 when each restricting pin 42 contacts the lower end of the guide groove 432. Hence, because the lens surface of the LED array 40 is located at an upper position than the lowest part of the developing cartridge 50, interference between the lens surface and the photosensitive drum 61 can be reliably prevented when the developing-section drawer 100 is pulled out. Further, because movement of the LED array 40 is restricted by the guide members 430 at the first separated position, the LED array 40 is configured to be held between the guide members 430 and the coil spring 420. Thus, wobbles of the LED array 40 can be suppressed when the developing-section drawer 100 is pulled out.

As shown in FIG. 3, a control board 500 (a first control board) is provided at the right-side side wall 101 of the developing-section drawer 100 for outputting lighting signals (blink signals) to a plurality of LEDs constituting the LED array 40. The control board 500 is connected to a main board 510 (a second control board) provided at the apparatus main body 10 via a flat cable 520 having a flat shape. Here, the main board 510 receives a print command outputted from a personal computer or the like, and performs controls of converting image data included in the print command into lighting signals of each LED, and the like. Further, the control board 500 is configured to output lighting signals received from the main board 510 to each LED.

The flat cable 520 has a shape including a first extending section 521, a second extending section 522, and a bend section 523. The first extending section 521 is provided to be in parallel with (in confrontation with) the side wall 101 of the developing-section drawer 100 and the developing-section guide 120. The first extending section 521 extends in the front-rear direction (the pulling direction of the developing-section drawer 100) to be connected to the control board 500.

The second extending section 522 is so provided that a surface of the second extending section 522 is substantially perpendicular to the front-rear direction. The second extending section 522 extends substantially in the vertical direction (a direction perpendicular to the pulling direction) along a right-side side wall 16 of the apparatus main body 10, and is connected to the main board 510. The bend section 523 is formed by bending connection between the first extending section 521 and the second extending section 522.

Figure 9:
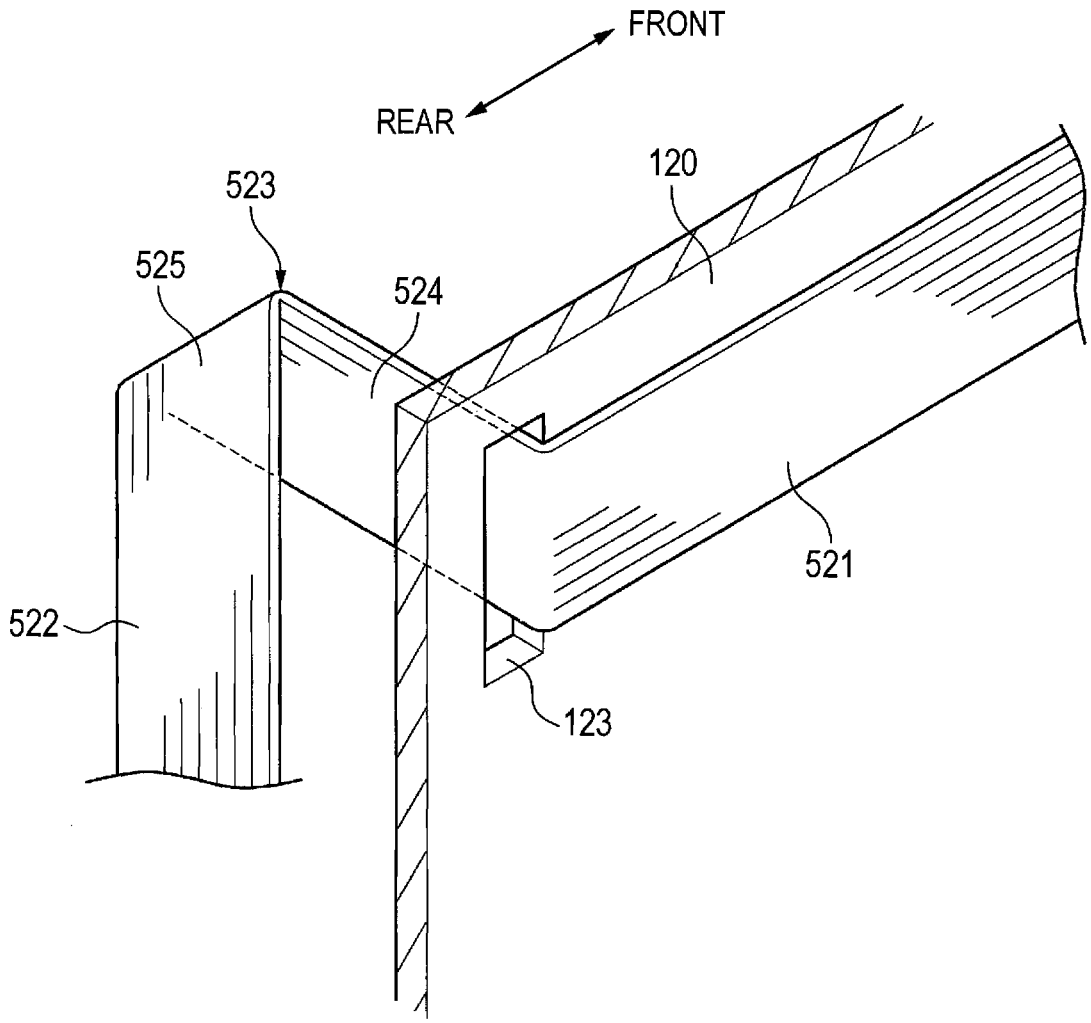
FIG. 9 is an enlarged perspective view showing a bend section of a flat cable.

Specifically, as shown in FIG. 9, the bend section 523 includes a first bend section 524 and a second bend section 525. The first bend section 524 is formed by bending the rear end of the first extending section 521 approximately at 90 degrees outward in the left-right direction. The second bend section 525 is formed by folding the outer end of the first bend section 524 (the outer end in the left-right direction) toward the lower direction. The first bend section 524 extends through a holding hole 123 formed in the developing-section guide 120, and is affixed to (held by) the holding hole 123 or the like with adhesive etc.

With this configuration, when the developing-section guide 120 is moved vertically, the first extending section 521 and the bend section 523 of the flat cable 520 move together with the developing-section guide 120, and only the second extending section 522 deforms in the thickness direction. Further, when the developing-section drawer 100 is moved forward or rearward, only the first extending section 521 is folded in a U-shape so that its flat surfaces confront each other, or deforms such that the folded U-shape is unfolded. That is, deformation of the flat cable 520 in the width direction is prevented during vertical movement of the developing-section guide 120 or during forward or rearward movement of the developing-section drawer 100. This suppresses bending of the flat cable 520 in the width direction, thereby suppressing fatigue failure of a signal-line cable.

The developing cartridge 50 is provided with inputting members 51 (FIG. 3) to which power for driving each internal member such as the developing roller is inputted. The inputting member 51 is exposed to outside through a through-hole 103 formed in the left-side side wall 101 of the developing-section drawer 100. As shown in FIG. 7, drive coupling sections 161 are provided at a left-side side wall 16 of the apparatus main body 10. The drive coupling sections 161 are connected to the inputting members 51 of the developing cartridges 50 for transmitting driving power to the inputting members 51. Note that driving power is transmitted from a driving source such as a motor (not shown) to the drive coupling sections 161 via a transmission mechanism such as gears.

The four drive coupling sections 161 are provided for the respective ones of the four developing cartridges 50, and are arranged to be aligned in the front-rear direction between the developing-section guide 120 and the photosensitive-member guide 220 located at the respective adjacent positions.

According to the above-described embodiment, the following effects can be obtained.

Even when the color printer 1 is disposed in a space in a shelf or the like that is narrow vertically, the developing-section drawer 100 is configured to be pulled out to the external position through the opening 11 at the front side. Thus, replacement of the developing cartridges 50 can be performed easily. Further, the developing-section drawer 100 is separated from the photosensitive drums 61 with the developing-section displacement mechanism 110, so that the LED arrays 40 are separated from the photosensitive drums 61. Thus, interference between the LED arrays 40 and the photosensitive drums 61 can be prevented when the developing-section drawer 100 is pulled out. Further, because the developing-section drawer 100 is configured to be pulled out from the front side, a replacement operation can be performed easily, compared with a structure where a top cover is opened to replace developing sections through a top opening.

The plurality of photosensitive drums 61 is arranged to be aligned in the pulling direction of the developing-section drawer 100, and is supported by the photosensitive-member drawer 200 that is movable in the pulling direction through the opening 11. Thus, the plurality of photosensitive drums 61 is configured to be replaced at a time, so that the replacement operation can be performed easily.

The guide roller 41 is pressed against the photosensitive drum 61 with the urging force of the coil spring 420, thereby restricting movement of the LED array 40 toward the photosensitive drum 61 side. Thus, the distance between the LED array 40 (the lens surface) and the photosensitive drum 61 can be kept at a constant value, and the LED array 40 is configured to be positioned relative to the photosensitive drum 61 with respect to the optical axis direction.

The movement of the LED array 40 toward the photosensitive drum 61 side is restricted by the guide members 430 at the first separated position, such that the lens surface of the LED array 40 is located at an upper position than the lowest part of the developing cartridge 50. Thus, interference between the lens surface and the photosensitive drum 61 can be reliably prevented when the developing-section drawer 100 is pulled out. Further, because movement of the LED array 40 is restricted by the guide members 430 at the first separated position, the LED array 40 is configured to be held between the guide members 430 and the coil spring 420. Thus, when the developing-section drawer 100 is pulled out, wobbles of the LED array 40 can be suppressed, and interference between the LED array 40 and the developing cartridge 50 can be suppressed.

The developing-section displacement mechanism 110 moves in conjunction with the front cover 12. Thus, operability of the developing-section drawer 100 can be improved, compared with a structure where a developing-section displacement mechanism is manually operated after a front cover is opened.

Deformation of the flat cable 520 in the width direction can be prevented at vertical movement of the developing-section guide 120 and at forward or rearward movement of the developing-section drawer 100. Thus, damages of the flat cable 520 can be suppressed. Further, because the second extending section 522 of the flat cable 520 is provided to be perpendicular to the front-rear direction, the second extending section 522 is configured to be deformed in the front-rear direction. Thus, compared with a structure where the second extending section 522 is deformed in the left-right direction, interference between the flat cable 520 and an inside member in the left-right direction (for example, the fixing unit 80 etc.) can be reliably suppressed.

The developing-section drawer 100 and the photosensitive-member drawer 200 are displaced to the respective separated positions only by opening the front cover 12. Then, only by pulling out the developing-section drawer 100 and the like, replacement of the developing cartridges 50 and the like can be performed easily, thereby improving operability.

Means for vertically moving the developing-section drawer 100 and the photosensitive-member drawer 200 in conjunction with an open/close operation of the front cover 12 is implemented by a mechanical mechanism including the developing-section displacement mechanism 110, the photosensitive-member displacement mechanism 210, and the interlocking mechanism 300. Thus, for example, compared with a structure where an open/close operation of the front cover is detected by a sensor and a motor is controlled based on signals from the sensor to vertically move each drawer, electrical components such as the motor are unnecessary and the costs can be reduced.

The swing shaft 131A of the swing cam 131 is disposed at a position closer to the developing-section guide 120 (the developing-section drawer 100) than the swing shaft 12A of the front cover 12 is. Hence, for example, compared with a structure where the swing axis of the swing cam is located at the same position as the swing shaft of the front cover, the amount of movement of the swing cam 131 in the vertical direction can be secured while reducing the amount of movement of the swing cam 131 in the front-rear direction. Thus, the apparatus main body 10 can be downsized in the front-rear direction.

The pair of developing-section guides 120 is arranged in the spaces formed at the left and right sides of the discharge tray section 13 so as to sandwich the discharge tray section 13. Thus, the spaces formed at the left and right sides of the discharge tray section 13 can be utilized efficiently as spaces for arranging the developing-section guides 120, thereby enabling the apparatus main body 10 to be downsized in the vertical direction.

Figure 10:
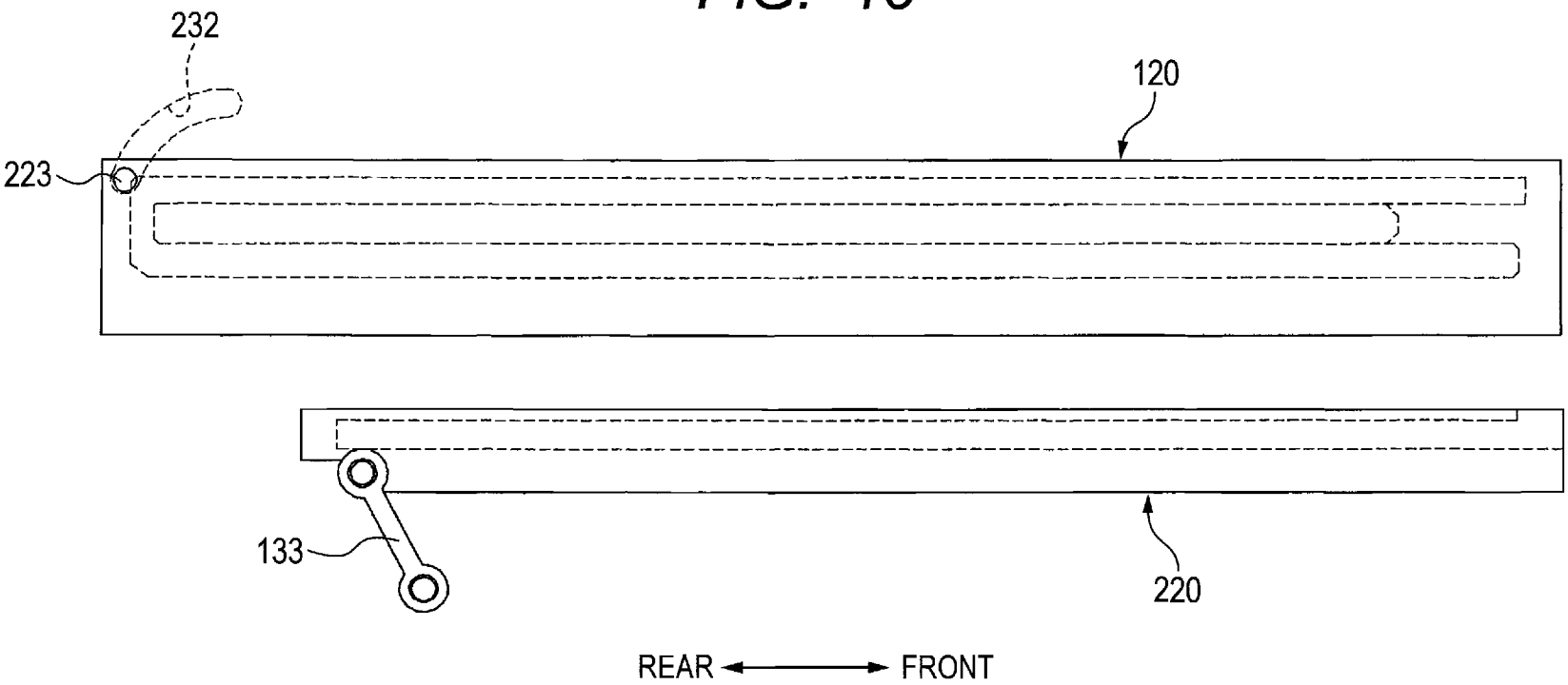
FIG. 10 is an explanatory diagram schematically showing cam mechanisms according to a modification.

While the invention has been described in detail with reference to the above aspects thereof, it would be apparent to those skilled in the art that various changes and modifications may be made therein without departing from the scope of the claims. In the following descriptions, like parts and components are designated by the same reference numerals to avoid duplicating description In the above-described embodiment, the first cam mechanism 130 is constructed by the swing cam 131, the arc-like member 132, and the rear support member 133, and the second cam mechanism 230 is constructed by the front cam groove 231, the rear cam groove 232, the front protrusion 222, and the rear protrusion 223. However, the invention is not limited to this configuration. For example, as shown in FIG. 10, the rear support member 133 and a combination of the rear protrusion 223 and the rear cam groove 232 may be switched.

Figure 11:
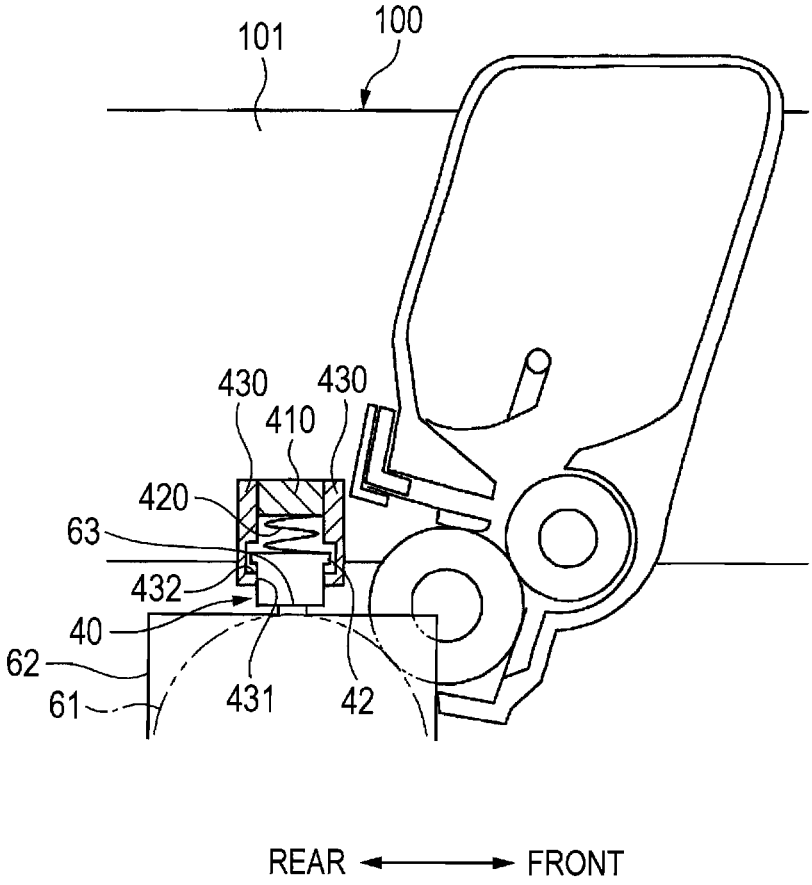
FIG. 11 is an enlarged cross-sectional view showing an LED array and its surrounding structure according to another modification, for specifically illustrating a structure for maintaining an interval between a lens surface of the LED array and a photosensitive drum at a first adjacent position.

In the above-described embodiment, the guide roller 41 provided to the LED array 40 is illustrated as an example of the first restricting member. However, the invention is not limited to this configuration. For example, as shown in FIG. 11, protrusions 63 for contacting the LED array 40 may be provided at the left and right sides of a holding member 62 configured to hold the photosensitive drum 61, such that an interval between the lens surface of the LED array 40 and the photosensitive drum 61 is maintained by the protrusions 63.

In the above-described embodiment, the photosensitive drum 61 is illustrated as an example of the photosensitive member. However, the invention is not limited to this configuration. For example, a belt-shaped photosensitive member may be used.

In the above-described embodiment, the developing cartridges 50 (a cartridge that is integrally constructed by a toner cartridge accommodating toner and a developing unit having a developing roller etc.) are illustrated as an example of the developing section. However, the invention is not limited to this configuration. If the toner cartridge and the developing unit are constructed as separate components, the developing unit may be used as an example of the developing section.

In the above-described embodiment, the LED array 40 is illustrated as an example of the exposing member. However, the invention is not limited to this configuration. For example, a large number of light emitting elements such as EL (electroluminescence) elements, phosphors, or the like may be arranged, and these light emitting elements may be lighted selectively in accordance with image data. Alternatively, a large number of light shutters made of liquid crystal elements, PLZT, or the like may be arranged for one light source, and open/close periods of the light shutters may be controlled selectively in accordance with image data so as to control light from the light source.

In the above-described embodiment, the coil spring 420 is illustrated as an example of the urging member. However, the invention is not limited to this configuration. For example, a leaf spring, a wire spring, or the like may be used.

In the above-described embodiment, the guide member 430 having the guide groove 432 is illustrated as an example of the second restricting member. However, the invention is not limited to this configuration. For example, another member separate from the guide member guiding the LED array may be used as the second restricting member.

In the above-described embodiment, the conveying belt 71 for conveying paper P is illustrated as an example of the belt. However, the invention is not limited to this configuration. For example, the belt may be an intermediate transfer belt onto which a toner image on the photosensitive drum is transferred.

In the above-described embodiment, the bend section 523 is constructed by bending twice (at two positions). However, the invention is not limited to this configuration. For example, the bend section may be constructed by bending three times or more.

In the above-described embodiment, both of the developing-section drawer 100 and the photosensitive-member drawer 200 are pulled out of the apparatus main body 10 in the same direction (the pulling direction). However, the developing-section drawer 100 and the photosensitive-member drawer 200 may be pulled out in different directions.

In the above-described embodiment, the invention is applied to the color printer 1. However, the invention is not limited to this configuration and, for example, may be applied to other kinds of image forming apparatuses such as a copier, a multifunction device, and the like.

What is claimed is:

1. An image forming apparatus comprising:

an apparatus main body having an opening at a front side;

a plurality of photosensitive members;

a plurality of developing sections each provided for a corresponding one of the plurality of photosensitive members;

a developing-section supporting member configured to hold the plurality of developing sections and configured to be pulled in a pulling direction through the opening from one of a plurality of internal positions inside the apparatus main body to an external position outside the apparatus main body at which the plurality of developing sections is configured to be mounted and dismounted;

a plurality of exposing members each provided for a corresponding one of the plurality of photosensitive members and configured to emit light in an optical axis direction for forming a latent image on the corresponding one of the plurality of photosensitive members, the plurality of exposing members being provided at the developing-section supporting member; and a displacement mechanism configured to support the developing-section supporting member and to displace the developing-section supporting member between: an adjacent position at which the developing-section supporting member is adjacent to the plurality of photosensitive members; and a separated position at which the developing-section supporting member is separated from the plurality of photosensitive members, the plurality of internal positions including the adjacent position and the separated position, wherein, when the developing-section supporting member is moved to the separated position by the displacement mechanism, each of the plurality of exposing members is separated from the corresponding one of the plurality of photosensitive members, and wherein, when the developing-section supporting member is pulled in the pulling direction from the separated position to the external position, the plurality of exposing members moves together with the developing-section supporting member to external positions outside of the apparatus main body.

2. The image forming apparatus according to claim 1, further comprising a photosensitive-member supporting member that is configured to move in the pulling direction through the opening, wherein the plurality of photosensitive members is arranged in the pulling direction and is supported by the photosensitive-member supporting member.

3. The image forming apparatus according to claim 1, further comprising:

an urging member provided at the developing-section supporting member and configured to urge each of the plurality of exposing members toward the corresponding one of the plurality of photosensitive members; and a first restricting member provided at either a member configured to hold one of the plurality of photosensitive members or one of the plurality of exposing members, the first restricting member being configured, at the adjacent position, to restrict movement of the one of the plurality of exposing members toward a photosensitive member side, wherein, when the developing-section supporting member is located at the adjacent position, the first restricting member restricts movement of the one of the plurality of exposing members, thereby positioning the one of the plurality of exposing members relative to the corresponding one of the plurality of photosensitive members.

4. The image forming apparatus according to claim 3, wherein the first restricting member comprises a roller provided to the one of the plurality of exposing members and configured to contact the corresponding one of the plurality of photosensitive members.

5. The image forming apparatus according to claim 3, further comprising a second restricting member provided at the developing-section supporting member, the second restricting member being configured, at the separated position, to contact one of the plurality of exposing members, thereby restricting movement of the one of the plurality of exposing members toward the photosensitive member side, wherein, at the separated position, the second restricting member is disposed in such a manner that a lower surface of the one of the plurality of exposing members is located above a lower end of a corresponding one of the plurality of developing sections.

6. The image forming apparatus according to claim 5, wherein each of the plurality of exposing members has a restricting protrusion; and wherein the second restricting member has a guide groove that is configured to engage the restricting protrusion at the separated position.

7. The image forming apparatus according to claim 1, wherein the displacement mechanism comprises a developing-section guide supporting the developing-section supporting member in such a manner that the developing-section supporting member is configured to slide in the pulling direction; and wherein the displacement mechanism displaces the developing-section supporting member by displacing the developing-section guide.

8. The image forming apparatus according to claim 1, further comprising:

a cover configured to move between a closed position at which the opening is closed and an open position at which the opening is opened; and an interlocking mechanism configured to interlock the cover with the displacement mechanism in such a manner that the developing-section supporting member moves from the adjacent position to the separated position when the cover moves from the closed position to the open position.

9. The image forming apparatus according to claim 1, further comprising a belt that is provided to confront the plurality of photosensitive members.

10. The image forming apparatus according to claim 7, wherein each of the plurality of exposing members comprises an LED array in which a plurality of LEDs is arranged.

11. The image forming apparatus according to claim 10, further comprising a first control board that is provided at a side wall of the developing-section supporting member, the control board being configured to output lighting signals to the plurality of LEDs.

12. The image forming apparatus according to claim 11, further comprising:

a second control board provided at the apparatus main body; and a flat cable connecting the first control board with the second control board, the flat cable comprising:

a first extending section extending in parallel with the side wall of the developing-section supporting member and in the pulling direction, and connecting to the first control board;

a second extending section extending in a direction perpendicular to the pulling direction such that a flat surface of the second extending section is perpendicular to the pulling direction, and connecting to the second control board; and a bend section having a bent shape and connecting the first extending section with the second extending section, wherein the bend section is held by the developing-section guide.

13. The image forming apparatus according to claim 1, wherein the developing-section supporting member is a developing-section drawer having a pair of side walls; and wherein the developing-section drawer is configured to hold the plurality of developing sections between the pair of side walls.

14. The image forming apparatus according to claim 2, wherein the developing-section supporting member is located above the photosensitive-member supporting member, and wherein lower surfaces of the plurality of exposing members are located above lower ends of the plurality of developing sections.

15. The image forming apparatus according to claim 7, wherein the developing-section guide has a groove extending in the pulling direction, and wherein the developing-section supporting member is configured to slide along the groove.

16. The image forming apparatus according to claim 13, further comprising a plurality of support frames each extending between the pair of side walls and being fixed to the pair of side walls, wherein the plurality of exposing members is provided at respective ones of the plurality of support frames.

17. An image forming apparatus comprising:

an apparatus main body having an opening at a front side;

a plurality of photosensitive members;

a plurality of developing sections each provided for a corresponding one of the plurality of photosensitive members;

a developing-section supporting member configured to hold the plurality of developing sections and configured to be pulled in a pulling direction through the opening from an internal position inside the apparatus main body to an external position outside the apparatus main body at which the plurality of developing sections is configured to be mounted and dismounted;

a plurality of exposing members each provided for a corresponding one of the plurality of photosensitive members and configured to emit light in an optical axis direction for forming a latent image on the corresponding one of the plurality of photosensitive members, the plurality of exposing members being provided at the developing-section supporting member;

a displacement mechanism configured to support the developing-section supporting member and to displace the developing-section supporting member between: an adjacent position at which the developing-section supporting member is adjacent to the plurality of photosensitive members; and a separated position at which the developing-section supporting member is separated from the plurality of photosensitive members;

an urging member provided at the developing-section supporting member and configured to urge each of the plurality of exposing members toward the corresponding one of the plurality of photosensitive members; and a first restricting member provided at either a member configured to hold one of the plurality of photosensitive members or one of the plurality of exposing members, the first restricting member being configured, at the adjacent position, to restrict movement of the one of the plurality of exposing members toward a photosensitive member side, wherein, when the developing-section supporting member is located at the adjacent position, the first restricting member restricts movement of the one of the plurality of exposing members, thereby positioning the one of the plurality of exposing members relative to the corresponding one of the plurality of photosensitive members, wherein, when the developing-section supporting member is located at the separated position, the one of the plurality of exposing members is separated from the corresponding one of the plurality of photosensitive members, wherein the image forming apparatus further comprises a second restricting member provided at the developing-section supporting member, the second restricting member being configured, at the separated position, to contact one of the plurality of exposing members, thereby restricting movement of the one of the plurality of exposing members toward the photosensitive member side, and wherein, at the separated position, the second restricting member is disposed in such a manner that a lower surface of the one of the plurality of exposing members is located above a lower end of a corresponding one of the plurality of developing sections.

18. An image forming apparatus comprising:

an apparatus main body having an opening at a front side;

a plurality of photosensitive members;

a plurality of developing sections each provided for a corresponding one of the plurality of photosensitive members;

a developing-section supporting member configured to hold the plurality of developing sections and configured to be pulled in a pulling direction through the opening from an internal position inside the apparatus main body to an external position outside the apparatus main body at which the plurality of developing sections is configured to be mounted and dismounted;

a plurality of exposing members each provided for a corresponding one of the plurality of photosensitive members and configured to emit light in an optical axis direction for forming a latent image on the corresponding one of the plurality of photosensitive members, the plurality of exposing members being provided at the developing-section supporting member; and a displacement mechanism configured to support the developing-section supporting member and to displace the developing-section supporting member between: an adjacent position at which the developing-section supporting member is adjacent to the plurality of photosensitive members; and a separated position at which the developing-section supporting member is separated from the plurality of photosensitive members, wherein the displacement mechanism comprises a developing-section guide supporting the developing-section supporting member in such a manner that the developing-section supporting member is configured to slide in the pulling direction, wherein the displacement mechanism displaces the developing-section supporting member by displacing the developing-section guide, wherein each of the plurality of exposing members comprises and LED array in which a plurality of LEDs is arranged, and wherein the image forming apparatus further comprises a first control board that is provided at a side wall of the developing-section supporting member, the control board being configured to output lighting signals to the plurality of LEDs.

* * * * *